US010086247B1

(12) United States Patent
Gaffney

(10) Patent No.: US 10,086,247 B1
(45) **Date of Patent: *Oct. 2, 2018**

(54) GOLF CLUB HEAD COVER WITH LINER

(71) Applicant: John Travis Gaffney, Phoenix, AZ (US)

(72) Inventor: John Travis Gaffney, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/618,515

(22) Filed: Jun. 9, 2017

Related U.S. Application Data

(63) Continuation of application No. 15/002,294, filed on Jan. 20, 2016, now Pat. No. 9,675,858.

(60) Provisional application No. 62/105,625, filed on Jan. 20, 2015.

(51) Int. Cl.
*A63B 55/00* (2015.01)
*A63B 60/62* (2015.01)

(52) U.S. Cl.
CPC ..... *A63B 60/62* (2015.10)

(58) Field of Classification Search
CPC ..... A63B 55/404; A63B 60/62
USPC ..... 150/160; 206/315.4
See application file for complete search history.

(56) References Cited

U.S. PATENT DOCUMENTS 2,526,985 A 10/1950 Whitehead
3,023,795 A * 3/1962 Denkert ..... A63B 60/62 150/160
3,128,812 A * 4/1964 Scheurer ..... A63B 55/408 128/DIG. 15
3,303,865 A 2/1967 Duimet
3,548,908 A * 12/1970 Koetting ..... A63B 60/62 150/160
3,556,186 A * 1/1971 Besthorne ..... B65D 31/00 383/109
3,821,976 A * 7/1974 Smith ..... A63B 60/62 150/160
3,861,434 A * 1/1975 Harding ..... A63B 60/62 150/160
3,965,955 A * 6/1976 Price ..... A63B 60/62 150/160
5,704,475 A * 1/1998 Jack ..... A63B 55/406 150/159
6,321,805 B1 11/2001 Suggs
9,675,858 B1 * 6/2017 Gaffney ..... A63B 60/62
2001/0035243 A1 * 11/2001 Choe ..... A63B 60/62 150/160
2006/0054258 A1 * 3/2006 Lamparello ..... A63B 60/62 150/160
2007/0261976 A1 * 11/2007 Anderson ..... A63B 55/406 206/315.4

* cited by examiner

*Primary Examiner* — Sue A Weaver
(74) *Attorney, Agent, or Firm* — IPTechLaw

(57) ABSTRACT

A golf club head cover includes an outer shell having a first closed end and a second open end providing access to an internal cavity. A flexible liner is included substantially within the internal cavity of the outer shell, the flexible liner fixedly coupled with the outer shell around the second open end and at two or more tabs extending from an outer surface of the flexible liner to an inner surface of the outer shell.

20 Claims, 3 Drawing Sheets

GOLF CLUB HEAD COVER WITH LINER

CROSS REFERENCE TO RELATED APPLICATIONS

This application is a continuation application of the earlier U.S. Utility Patent Application to Gaffney entitled "Golf Club Head Cover with Liner," application serial number 15002294, filed on Jan. 20, 2016, which claims the benefit of the filing date of U.S. Provisional Patent Application 62/105,625, entitled "Golf Club Head Cover and Liner" to John Travis Gaffney which was filed on Jan. 20, 2015, the disclosures of which are hereby incorporated entirely herein by reference.

BACKGROUND

1. Technical Field

Aspects of this document relate generally to sporting equipment, particularly golf clubs and covers.

2. Background

Golf head covers are conventionally used while the various clubs required to play are carried in a bag or cart. Conventional golf head covers include "sock" types of golf club covers often used for protecting the woods. A wide variety of other cover shapes and types have been developed to cover the heads of irons and putters. Each design attempts to balance many factors, which include ease of use, durability, degree of protection of the head, and cost.

SUMMARY

Implementations of golf club head covers may include: an outer shell having a first closed end and a second open end, the outer shell forming an internal cavity accessible through the second open end of the outer shell, and; a flexible liner included substantially within the internal cavity of the outer shell, the flexible liner fixedly coupled with the outer shell around the second open end and at two or more tabs extending from an outer surface of the flexible liner to an inner surface of the outer shell.

Implementations of golf club head covers may include one, all, or any of the following:

A majority of the flexible liner may be included within the internal cavity of the outer shell.

All of the flexible liner may be included within the internal cavity of the outer shell.

The flexible liner may include an internal cavity.

The internal cavity of the flexible liner may be accessible only through the second open end of the outer shell.

The outer shell may include an elastic material biased to compress a portion of the outer shell.

The outer shell may exclude an elastic material biased to compress a portion of the outer shell.

The flexible liner may be fixedly coupled with the outer shell only around the second open end and at two tabs extending from the outer surface of the flexible liner to the inner surface of the outer shell.

The flexible liner may have a narrow section and two of the two or more tabs may be located at the narrow section.

One of the two or more tabs may couple the flexible liner to the outer shell at the first closed end of the outer shell.

The flexible liner may include a first closed end and a second open end.

The flexible liner may have an hourglass shape.

Implementations of golf club head covers may include: an outer shell forming a first internal cavity accessible through a mouth of the outer shell, and; a flexible liner included substantially within the first internal cavity, the flexible liner forming a second internal cavity accessible through a mouth of the flexible liner; wherein the mouth of the outer shell and the mouth of the flexible liner are fixedly joined so that the mouth of the flexible liner is accessible only through the mouth of the outer shell, and; wherein the flexible liner is fixedly coupled with the outer shell only at the mouth of the outer shell and through two or more tabs extending between the flexible liner and the outer shell.

Implementations of golf club head covers may include one, all, or any of the following:

A majority of the flexible liner may be included within the first internal cavity of the outer shell.

All of the flexible liner may be included within the first internal cavity of the outer shell.

The second internal cavity of the flexible liner may be accessible only through the mouth of the outer shell.

The outer shell may include an elastic material coupled thereto, the elastic material biased to compress a portion of the outer shell.

The flexible liner may have an hourglass shape.

The flexible liner may have a narrow section and two of the two or more tabs may be located at the narrow section.

The flexible liner may be fixedly coupled with the outer shell only at three locations.

Implementations of golf club head covers may include: an outer shell having a first closed end and a second open end, the outer shell forming an internal cavity accessible through the second open end of the outer shell, and; a flexible liner included substantially within the internal cavity, the flexible liner fixedly coupled with the outer shell around the second open end and at two tabs extending from an outer surface of the flexible liner to an inner surface of the outer shell.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended golf club head covers with liners and related methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such golf club head covers with liners and related methods, and implementing components and methods, consistent with the intended operation and methods.

Figure 1A:
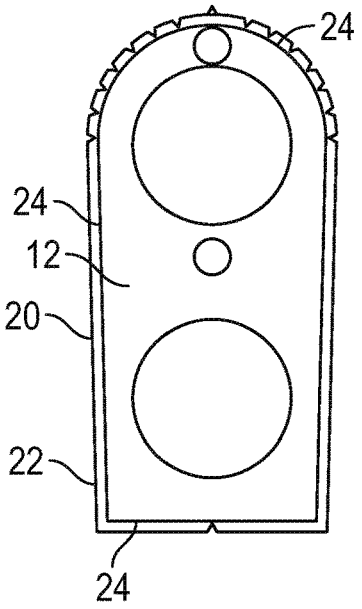
FIG. 1A is a front view of a pattern used to form an outer shell of an implementation of a golf club head cover.
Figure 1B:
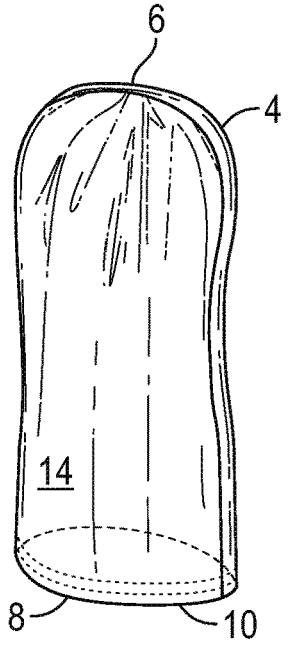
FIG. 1B is a front perspective view of an implementation of an outer shell of a golf club head cover formed using the pattern of FIG. 1A.

Referring now to FIG. 1A, in implementations a pattern 20 having two halves 22 may be used to form an outer shell 4 of a golf club head cover. Each half 22 may be formed of a material such as leather, a cloth material, or some other rigid, non-rigid, or elastic material or layers of such materials coupled together. In the representative example shown in the drawings the halves are each made of leather or an imitation leather material. The halves may be sewn together with stitching 24, or they may be joined in some other manner, such as with glue, heat, and so forth. The inner surface of the outer shell is seen in FIG. 1A, but after the stitching is added, the outer shell may be inverted so that the outer surface 14 is on the outside, as seen in FIG. 1B.

The outer shell 4 has a first closed end (closed end) 6 and a second open end (open end) 8. The outer shell forms an internal cavity (first internal cavity), defined by the inner surface 12 and accessible only through the second open end 8. The second open end forms a mouth 10 of the outer shell.

Figure 2A:
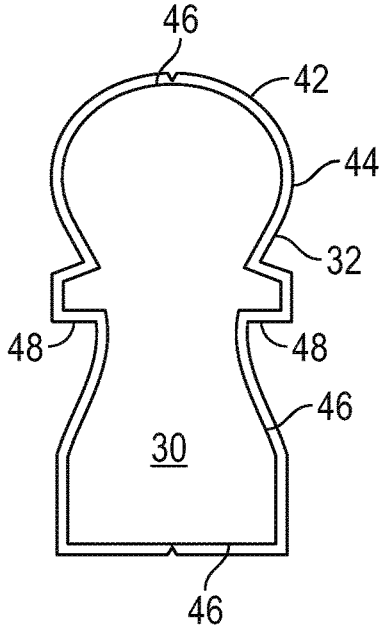
FIG. 2A is a front view of a pattern used to form a flexible liner of an implementation of a golf club head cover.
Figure 2B:
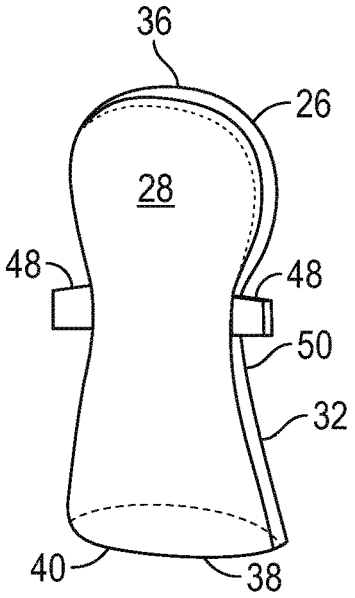
FIG. 2B is a front perspective view of an implementation of a flexible liner of a golf club head cover formed using the pattern of FIG. 2A.

FIG. 2A shows a pattern 42 that may be used to form a flexible liner 26 of a golf club head cover. The pattern includes two halves 44, each of which has an hourglass shape 32 with a narrow section 50 and tabs (wings) 48 extending from the narrow section. The two halves may be coupled together, such as using stitching 46 or through another method. The inner surface 30 of the flexible liner is seen in FIG. 2A, but after the two halves have been joined the combination may be inverted so that the outer surface 28 is on the outside, forming the shape shown in FIG. 2B. In this assembled format the flexible liner 26 still has an hourglass shape 32.

The flexible liner has a first closed end (closed end) 36 and a second open end 38 opposite the first closed end. The second open end forms a mouth through which an internal cavity (second internal cavity) 34 (seen in FIGS. 5-6) may be accessed. The internal cavity is defined by the inner surface 30 of the flexible liner. The internal cavity receives a golf club head and a portion of a shaft of a golf club.

Figure 3A:
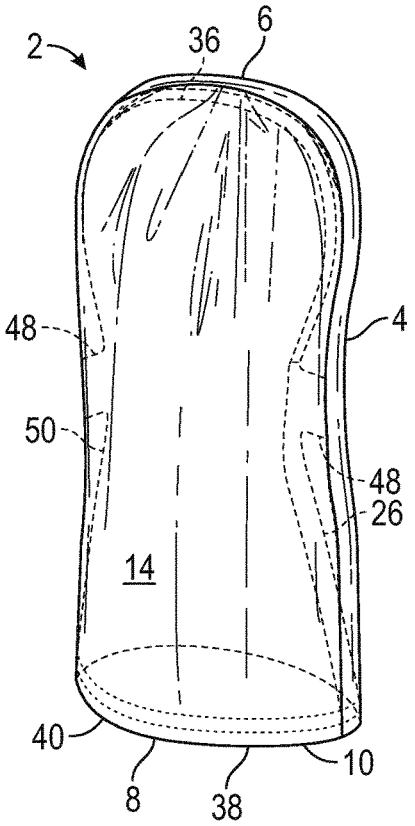
FIG. 3A is a rear perspective see-through view of an implementation of a golf club head cover including the outer shell of FIG. 1B and the flexible liner of FIG. 2B.
Figure 3B:
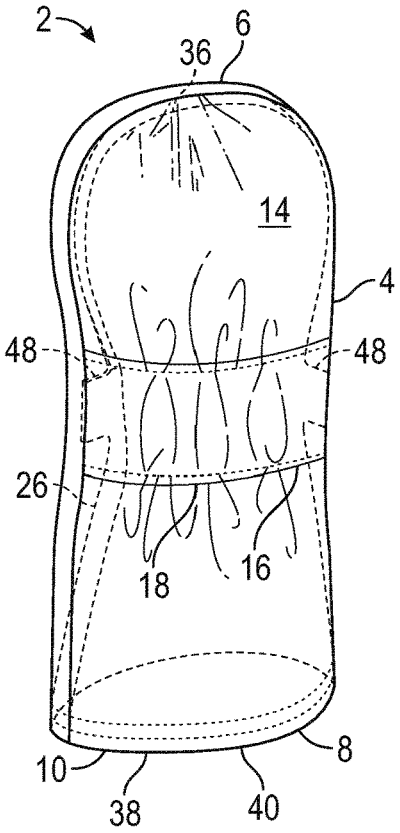
FIG. 3B is a front perspective see-through view of the golf club head cover of FIG. 3A.
Figure 4:
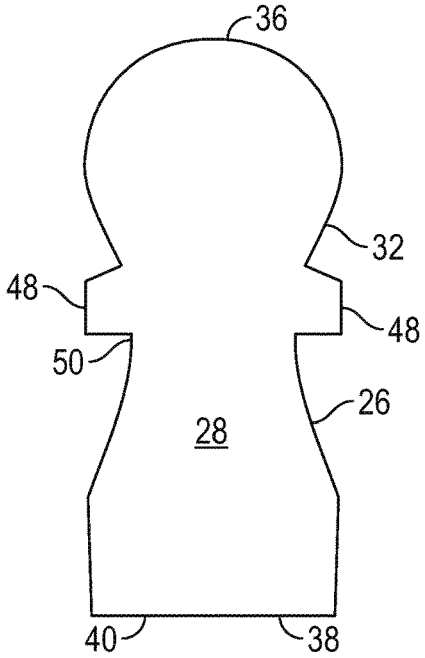
FIG. 4 is a front view of the flexible liner of FIG. 2B.

The flexible liner is coupled with the outer shell to form a golf club head cover (head cover) 2 as shown in FIGS. 3A-3B. The flexible liner is only coupled with the outer shell at a specific number of locations. In the representative examples shown in the drawings there are only three places where the two are joined. As can be seen in FIGS. 3A and 3B, for example, the flexible liner is joined with the outer shell around the second open end 8 and second open end (open end) 38, or in other words at the mouths 10 and 40—the edge of the flexible liner forming the mouth 40 and the edge of the outer shell forming the mouth 10 being joined together such as through stitching, glue, a heat weld, or some other mechanism. This seam or other juncture joining the mouths is thus, in implementations, a circular seam that surrounds the second open ends 8 and 38.

Additionally, the flexible liner is joined with the outer shell using two tabs 48. Thus, in the implementations shown the stitching of the mouths 10 and 40 together, and the stitching of the two tabs to the outer shell, creates only three locations where the flexible liner and the outer shell are fixedly coupled together. The mouth of the flexible liner may first be doubled back over upon itself and stitched in that formation before the mouth of the flexible liner is stitched with the mouth of the outer shell (or this doubling over may occur during the stitching that couples the two mouths together)—in other implementations there may be no doubling over of the flexible liner. The stitching may be replaced by glue, a heat weld, rivets or other fasteners, etc.

Other than these three attachment points, the flexible liner is free to move about or, in other words, "float," within the outer shell. When a golf club and a portion of a shaft are placed within the internal cavity 34 the flexible liner is free to move about and flex in order to receive the golf club head and shaft. The flexible liner is formed of a flexible material, such as an elastic, a flexible polymer, a rubbery material, an elastic fabric, or other elastic, inelastic, or stretchable material. In the implementations shown the flexible liner is formed of a material marketed under the tradename LYCRA by Invista, Inc. of Wichita, Kans. When the golf club head is removed from the internal cavity 34, the flexible liner may deform as the head is being removed therefrom, but the tabs will prevent the flexible liner from being pulled out from the internal cavity of the outer shell.

In various implementations, the flexible liner may be attached to the outer shell at one or more additional points, such as having the end of the flexible liner coupled to the first end of the outer shell, creating four attachment points.

Although only two tabs are shown in the representative examples, in other implementations, other numbers of tabs may be used. For example in implementations the two tabs shown in FIGS. 3A-3B may be present and, additionally, another tab may be present at a top of the flexible liner to couple the flexible liner with the outer shell at the first closed end of the outer shell. In other implementations, other numbers of tabs may be used, such as two at the top and two at the sides, or several along the perimeter of the seam joining the two halves of the flexible liner, and so forth.

Additionally, where more than two tabs are used, they may be all located in the same plane, or in different planes. For example the tabs may be only at the sides and top along the seam joining the two halves of the flexible liner (in other words all in the same plane) or some at the sides along the seam that joins the halves together and others at the front and back and not in the seam that joins the two halves together (and thus not in the same plane).

The size and configuration of the tabs may be designed so that the tabs pull laterally on the outer shell but do not pull downwards on the top of the outer shell as a golf club is being moved therein, so that the rounded shape of the closed second end of the outer shell is maintained. Various dimensions may be used for the tabs.

The hourglass shape 32 of the flexible liner forms a narrow section 50. This may allow the flexible liner to stay in position around a golf club head once a golf club head is inserted therein. For example, when a golf club head is inserted into the golf club head cover the flexible liner will stretch to allow the golf club head to pass through the narrow section and into the upper portion of the flexible liner. At the same time, the outer shell may be made of a non-elastic material and may be sized so that the golf club head can pass therein without the outer shell needing to stretch—thus all the stretching and holding may occur only in the flexible liner. In other implementations the outer shell may be formed, or partially formed, of a flexible material so that it too stretches or unfolds to accommodate the golf club head.

Figure 6:
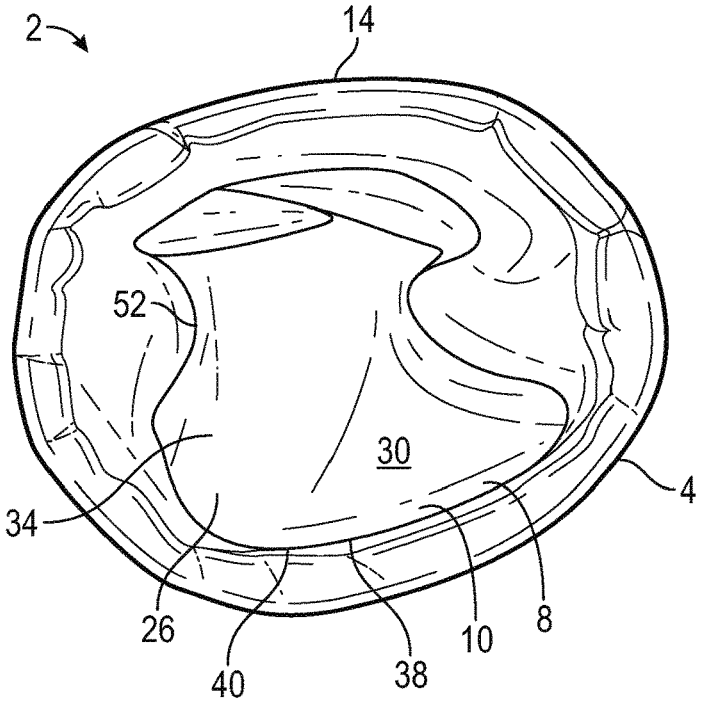
FIG. 6 is a bottom view of the golf club head cover of FIG. 3A.

Once the golf club head is in the upper portion of the flexible liner, the narrow section, which is biased towards its narrow configuration, tends to keep the golf club head cover in place over the golf club head—in other words it provides some resistance to the golf club head cover being removed. This resistance may be overcome through manual force alone, however, so that when a user pulls on the top of the golf club head cover the narrow section will stretch to allow the golf club head to be extracted therethrough and removed from the golf club head cover. In FIG. 6 a narrow opening 52, formed at the narrow section 50, may be seen as viewed from the bottom of the golf club head cover.

In some implementations the narrow section may be sized so that the shaft of the golf club is "gripped" by the narrow section or is somewhat tightly held therein (though in such implementations this force may be overcome with manual force alone of a user, as described above). In other implementations the shaft may reside in the golf club head cover loosely surrounded by the narrow section.

In implementations the outer shell may not be elastic and may have no elastic section formed therein. However, notwithstanding the outer shell not being elastic, it may be foldable. In other words, it may be formed of a material that cannot be easily stretched, but a material that is thin enough so that folds may be formed therein. Referring, for example, to FIG. 3B, in implementations an elastic section 16 of the outer shell may be formed by coupling an elastic material 18 to the outer shell. This could be coupled at the outer surface 14, or at the inner surface 12. In other implementations the outer shell may have more than one layer and the elastic material may be coupled between the two or more layers.

The elastic material may be formed of any material with desired elasticity, such as an elastic band, an elastic polymer, and elastic fabric, and so forth. It may be formed of the same material as the flexible liner in some implementations. As can be seen in FIG. 3B, the elastic section may be configured so that the elasticity of the elastic material tends to constrict the golf club head cover proximate the narrow section of the flexible liner. Thus, folds may be seen in the outer shell of FIG. 3B.

In such an implementation, when a golf club head is inserted into the golf club head cover the elastic section will stretch and the folds will unfold, thus allowing the outer shell to "expand" in a sense, although the actual physical material of the outer shell may not be stretching elastically.

Figure 5:
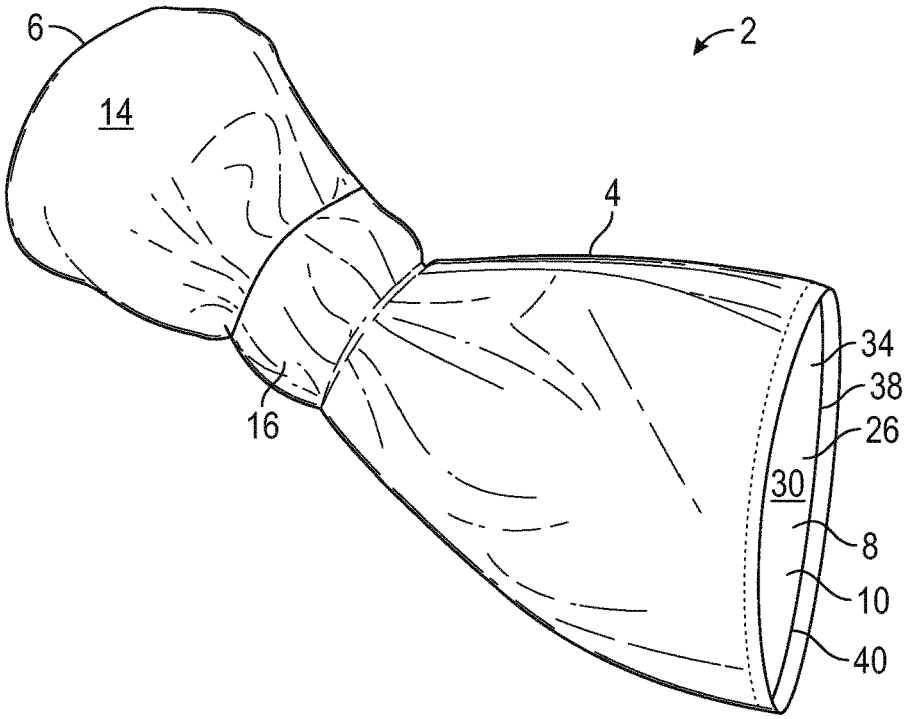
FIG. 5 is a front perspective view of the golf club head cover of FIG. 3A.

FIG. 5 also shows a version of a golf club head cover where an elastic section 16 is included, and the elastic section may help to form the narrow opening 52 (or may make the narrow opening more narrow) as seen in FIG. 6. The elastic section may thus assist with, or add to, the compression or constriction of the golf club head cover around a golf club head to help hold the golf club head cover in place over a golf club head.

The flexible liner may include a fur material at its inner surface 30, and this may serve to protect a golf club head and shaft from damage, such as from nicks, scratches, and dents that may otherwise occur by the golf club head or shaft hitting other items (such as other golf club heads or shafts). The fur material may also have a tendency to remove dirt, grass, or other debris from the golf club head as the golf club head is inserted into the golf club head cover.

In implementations in which an elastic section is included the tabs of the flexible liner may be coupled directly to the elastic material, so that the tabs are coupled with the outer shell only through the elastic material, though in other implementations the tabs could be directly attached to the outer shell—in the implementations shown each tab is directly stitched to the seam of the outer shell along an outer edge of the tab. In implementations in which an elastic section is included the elastic material may be stitched or otherwise coupled with one of the halves 22 of the outer shell before the halves are joined together, or the elastic section could be added after the two halves are joined together. The elastic material could be stitched to the outer shell along the longest lengths of the elastic material, or along its shortest lengths, or both.

The stretchable nature of the flexible liner (and in some cases the foldable nature of the outer shell) allows the golf club head cover to be used with various sizes of golf club heads, such as up to and including 460 cubic centimeter drivers. Because the elastic section may be excluded from the outer shell, in implementations the outer shell may have the same appearance and configuration (not folded/constricted, not stretched) regardless of the size of the golf club that is within the golf club head cover—in such implementations it is the flexible liner that does all of the stretching to accommodate and secure the golf club head.

When the outer shell and flexible liner are joined at the mouths the mouth of the outer shell may be doubled over into the internal cavity of the flexible liner and may partially cover the mouth of the flexible liner, and sewn or otherwise fixed in place, as seen in FIG. 5.

FIG. 6 shows that the width of the golf club head cover progressively narrows from the opening or mouth towards the narrow section, having a minimum width where the tabs are located. After that it progressively expands from the narrow section towards the first closed end 6, as may be envisioned by viewing the hourglass shape of the flexible liner in the drawings.

Although FIGS. 3A-3B show the flexible liner generally filling most of the upper portion of the internal cavity of the outer shell, this is only a representative illustration and it may be understood that, in a non-stretched configuration (when no golf club is therein) the flexible liner may only fill a small portion or a fraction—such as a half, or ¼, ⅓, ⅔, etc.—of the upper portion of the internal cavity of the outer shell. The flexible liner may, however, have sufficient elasticity so that it may stretch to completely fill the upper portion of the internal cavity of the outer shell when a golf club head is placed therein. This stretching may, as discussed, occur without any deformation of the outer shell—particularly in implementations wherein the outer shell includes no elastic section.

In particular implementations the outer shell includes no elastic section, and no rubber band or other constricting material is included outside the outer shell to constrict the outer shell around a golf club head.

In places where the description above refers to particular implementations of golf club head covers with liners and related methods and implementing components, sub-components, methods and sub-methods, it should be readily apparent that a number of modifications may be made without departing from the spirit thereof and that these implementations, implementing components, sub-components, methods and sub-methods may be applied to other golf club head covers with liners and related methods.

What is claimed is:

1. A golf club head cover, comprising:

an outer shell having a first closed end and a second open end, the outer shell forming an internal cavity accessible through the second open end of the outer shell, and;

a flexible liner comprised substantially within the internal cavity of the outer shell, the flexible liner fixedly coupled with the outer shell around the second open end and at two or more tabs extending from an outer surface of the flexible liner to an inner surface of the outer shell.

2. The golf club head cover of claim 1, wherein a majority of the flexible liner is comprised within the internal cavity of the outer shell.

3. The golf club head cover of claim 2, wherein all of the flexible liner is comprised within the internal cavity of the outer shell.

4. The golf club head cover of claim 1, wherein the flexible liner comprises an internal cavity, and wherein the internal cavity of the flexible liner is accessible only through the second open end of the outer shell.

5. The golf club head cover of claim 1, wherein the outer shell comprises an elastic material biased to compress a portion of the outer shell.

6. The golf club head cover of claim 1, wherein the outer shell does not comprise an elastic material biased to compress a portion of the outer shell.

7. The golf club head cover of claim 1, wherein the flexible liner is fixedly coupled with the outer shell only around the second open end and at two tabs extending from the outer surface of the flexible liner to the inner surface of the outer shell.

8. The golf club head cover of claim 1, wherein the flexible liner comprises a first closed end and a second open end.

9. The golf club head cover of claim 8, wherein the first closed end of the flexible liner is not directly coupled to the first closed end of the outer shell.

10. The golf club head cover of claim 1, wherein the two or more tabs are directly coupled to a sidewall of the outer shell and a sidewall of the flexible liner.

11. The golf club head cover of claim 1, wherein the flexible liner comprises an hourglass shape.

12. A golf club head cover, comprising:

an outer shell forming a first internal cavity accessible through a mouth of the outer shell, and;

a flexible liner comprised substantially within the first internal cavity, the flexible liner forming a second internal cavity accessible through a mouth of the flexible liner;

wherein the mouth of the outer shell and the mouth of the flexible liner are fixedly joined so that the mouth of the flexible liner is accessible only through the mouth of the outer shell, and;

wherein the flexible liner is fixedly coupled with the outer shell only at the mouth of the outer shell and through two or more tabs extending between the flexible liner and the outer shell; and wherein the two or more tabs are not directly coupled to one another.

13. The golf club head cover of claim 12, wherein a majority of the flexible liner is comprised within the first internal cavity of the outer shell.

14. The golf club head cover of claim 13, wherein all of the flexible liner is comprised within the first internal cavity of the outer shell.

15. The golf club head cover of claim 12, wherein the second internal cavity of the flexible liner is accessible only through the mouth of the outer shell.

16. The golf club head cover of claim 12, wherein the outer shell comprises an elastic material coupled thereto, the elastic material biased to compress a portion of the outer shell.

17. The golf club head cover of claim 12, wherein the flexible liner comprises an hourglass shape.

18. The golf club head cover of claim 12, wherein the flexible liner is only directly fixedly coupled to the outer shell at the mouth of the outer shell and the mouth of the flexible liner.

19. The golf club head cover of claim 12, wherein the flexible liner is fixedly coupled with the outer shell only at three locations.

20. A golf club head cover, consisting of:

an outer shell having a first closed end and a second open end, the outer shell forming an internal cavity accessible through the second open end of the outer shell, and;

a flexible liner comprised substantially within the internal cavity, the flexible liner fixedly coupled with the outer shell around the second open end and at two tabs extending from an outer surface of the flexible liner to an inner surface of the outer shell.

* * * * *